US005344700A

United States Patent [19]

McGath et al.

[11] Patent Number: 5,344,700

[45] Date of Patent: Sep. 6, 1994

[54] STRUCTURAL PANELS AND JOINT CONNECTOR ARRANGEMENT THEREFOR

[75] Inventors: James R. McGath, Metamora; John M. Roncone, Westchester; Thomas J. Bailey, Herrin, all of Ill.

[73] Assignee: Aliquot, Ltd., Metamora, Ill.

[21] Appl. No.: 859,133

[22] Filed: Mar. 27, 1992

[51] Int. Cl.[5] ..... B32B 9/00

[52] U.S. Cl. ..... 428/304.4; 428/306.6; 428/322.2; 428/297; 52/270; 52/580; 52/582; 52/595; 52/586.1

[58] Field of Search ..... 428/304.4, 306.6, 68, 428/86, 322.2, 71, 90, 297; 52/580, 595, 582, 270

[56] References Cited

U.S. PATENT DOCUMENTS 3,846,524 11/1974 Elmore et al. .
3,848,376 11/1974 Elmore .
4,091,142 5/1978 Elmore et al. ..... 428/322
4,186,539 2/1980 Harmon et al. ..... 52/595
4,918,895 4/1990 Landheer ..... 52/580
4,936,078 6/1990 Porter ..... 52/595

*Primary Examiner*—Patrick J. Ryan
*Assistant Examiner*—Abraham Bahta
*Attorney, Agent, or Firm*—Emrich & Dithmar

[57] ABSTRACT

A modular building structure includes a plurality of prefabricated structural panels disposed in side to side relation, the panels being joined in dovetail fashion with a tongue extending the edge of one panel being received in a groove extending along an edge of an adjacent panel, the mating inner surfaces of the tongue and the groove each having a semicircular indentation therein, the indentations being aligned with one another to form a generally cylindrical channel extending the length of the two adjacent panels in which is received a cylindrical connecting rod which connects the adjacent panels together side to side. The connecting rods are connected to the foundation and/or to the roof of the structure to thereby tie the roof and panels of the structure to the foundation.

4 Claims, 6 Drawing Sheets

24c
104
102
20

24b
16
14
24c
23
24
22
12
24a
18
46
24a
88
10
21

36
34
37
34
32
30

STRUCTURAL PANELS AND JOINT CONNECTOR ARRANGEMENT THEREFOR

BACKGROUND OF THE INVENTION

This invention relates to modular structures which are constructed from prefabricated panels, and more particularly, to structural panels and arrangements for interconnecting and for anchoring such structural panels.

Advancements in the building industry have resulted in the introduction of modular construction to permit mass-produced structures and eliminate many of the conventional on-site construction procedures which contribute to high building costs. The modular concept employs prefabricated structural components, such as wall and roof sections which are transported to the building site and assembled to form a structure. Examples of such prefabricated structural panels are disclosed in U.S. Pat. Nos. 3,846,524 and 4,091,142. Each of the panels has a projection or tongue portion extending the length of one vertical edge of the panel which is received in a complementary slot in the edge of an adjacent panel, forming a dovetail type joint between the adjacent panels. The panels are held together by adhesive deposited in the joint area or by bolting adjacent panels together. However, the joint provided by this panel connection arrangement does not provide positive alignment between the panels during the erecting of the structure and the panels may slip during the erecting of a structure.

Such prefabricated panels may be used as cladding panels to enclose structural steel framing for erecting factory buildings, warehouses and high-rise buildings, for example.

Moreover, the prefabricated structural panels may be used to construct modular building structures which are completely self-supporting, thereby eliminating the need for conventional support frame work.

In application in self-supporting structures, the panels have to be anchored to footings at the building site. One arrangement for anchoring modular structures which are comprised of prefabricated panels is disclosed in U.S. Pat. No. 3,848,376. In that arrangement, prefabricated wall panels are assembled together with their lower base portion disposed on a concrete footing which was previously poured to correspond to the interior floor plan for the structure. After the panels have been assembled together, a concrete layer or floor is poured to extend to the outer perimeter of the structure and cover a ledge formed at the junction of the base portion of the panels and an upper vertical portion of each wall panel to anchor the structure to the footing. A plurality of spaced upstanding plates extend upwardly into the concrete floor from the inner wall surface to lock the wall panel and the concrete layer against separation in a direction normal to the wall panel. However, such anchoring is not provided until after the structure has been erected, and the panels may slip during erecting of the structure.

SUMMARY OF THE INVENTION

It is an object of the present invention to provide an improved modular enclosure constructed from prefabricated panels.

A further object of the invention is to provide an improved prefabricated structural panel for use in enclosures, building structures, and the like.

Another object of the invention is to provide an improved joint connector for prefabricated panels which are used to construct modular building structures.

Another object of the invention is to provide an improved arrangement for anchoring prefabricated panels which form a modular building structure.

In accordance with the present invention, there is provided an enclosure including at least first and second prefabricated structural panels disposed in side by side relation, each panel having an upper edge, a lower edge and at least one side edge, the side edge of the first panel having a tongue portion extending between the upper and lower edges of the first panel, and the side edge of the second panel having a groove extending between the upper and lower edges of the second panel for receiving the tongue portion of the first panel when the first and second panels are arranged with their side edges disposed adjacent to one another, the tongue portion having first and second surfaces opposing respective first and second surfaces of the groove, a joint connector arrangement for interconnecting the panels comprising an indentation in at least said first surface of the tongue portion between the upper and lower edges of the first panel, an indentation in at least the first surface of the groove extending between the upper and lower edges of the second panel aligned with the indentation in the first surface of the tongue portion defining a channel of a predetermined cross-section when the tongue portion of the first panel is received in the groove of the second panel, said channel extending between the upper and lower edges of the panels, and an elongated member having a cross-section corresponding to the cross-section of the channel and extending axially of the channel to prevent relative movement between the first and second panels in a direction normal to the axis of said channel.

Further, in accordance with another aspect of the invention there is provided a joint connector arrangement for interconnecting first and second prefabricated panels, each panel having an upper edge, a lower edge and at least one side edge, the side edge of the first panel having a tongue portion extending between the upper and lower edges of the first panel, and the side edge of the second panel having a groove extending between the upper and lower edges of the second panel for receiving the tongue portion of the first panel when the first and second panels are arranged with their side edges disposed adjacent to one another, the tongue portion having first and second surfaces opposing respective first and second surfaces of the groove, the joint connector arrangement for interconnecting the panels comprising an indentation in at least said first surface of the tongue portion between the upper and lower edges of the first panel, an indentation in at least the first surface of the groove extending between the upper and lower edges of the second panel aligned with the indentation in the first surface of the tongue portion when the tongue portion of the first panel is received in the groove of the second panel, defining a channel of a predetermined cross-section, the channel extending between the upper and lower edges of the panels, and an elongated member having a cross-section corresponding to the cross-section of the channel and extending axially of said channel to prevent relative movement between the first and second panels in a direction normal to the axis of said channel.

In addition, there is provided a structural panel including a core of cured foam resin composition having a configuration corresponding substantially to the desired shape of the structural shape of the panel and including front and rear surfaces, and first and second side skin sheets integrally secured to front and rear surfaces of the core, at least one of the side skins being made of a cured fiber reinforced resin including a first layer of resin which has reinforcing material to provide increased strength for the sheet, and a second layer of resin on the first layer having a plurality of fibers with portions thereof embedded in the second layer and other portions of the fibers projecting from a surface thereof into and integrally adhering with the foam core, the improvement comprising first, second and third side skin portions interconnecting the first and second side skin sheets and secured to first, second and third side surfaces of the foam core, defining an enclosure for the foam core having an open end, and an insert member mounted in the open end of the enclosure and secured to the first and second side skin sheets and to at least the first and second side skin portions, whereby the foam core is encapsulated within the enclosure.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF PREFERRED EMBODIMENTS

Figure 1:
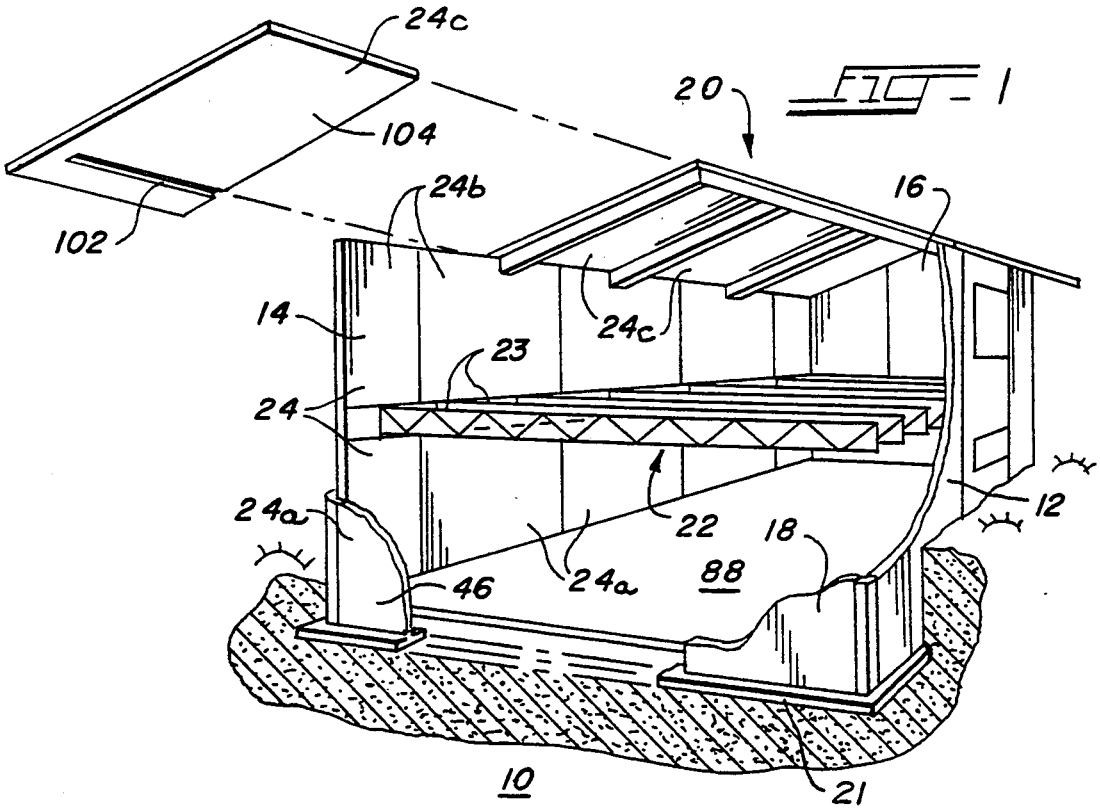
FIG. 1 is a perspective view, partially cut away, of a self-supporting modular building which is constructed from a plurality of prefabricated panels which are interconnected using the joint connector arrangement provided by the present invention.

Referring to the drawings, FIG. 1 illustrates a modular structure 10 which is constructed in accordance with prefabricated building techniques. The structure 10 includes four generally vertically disposed outer walls 12, 14, 16 and 18 which support a roof 20 to define an enclosed structure having a generally rectangular interior area. The walls are supported on a concrete footing 21 which is below grade. A floor section 22 divides the interior of the structure into first and second floors. The floor 22 is supported by structural beams 23 which span the interior of the structure.

Each of the walls and the roof are formed by a plurality of panels 24 which are molded to the required dimension and then transported to a building site for assembly into the modular structure. A first group of the panels **24*a* form the exterior walls of the lower floor of the structure. A second group of panels 24*b* form the exterior walls of the upper floor of the structure. A third group of panels 24*c* form the roof 20. These panels 24** are prefabricated under controlled factory conditions to form complete wall panels, roof panels, etc. All of these panels are completely finished before leaving the manufacturing facility and require assembly operations only at the construction site.

The panels 24 are joined together side to side by the joint connector arrangement provided in accordance with one aspect of the present invention. The joint connector arrangement anchors the panels to the foundation of the building structure and ties the roof to the foundation as will be shown.

Figure 2:
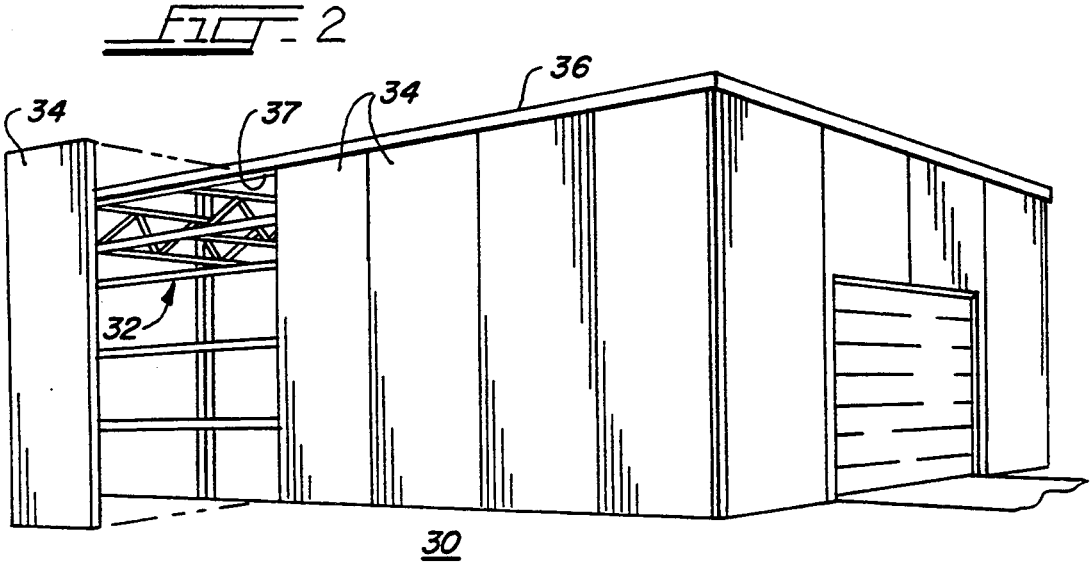
FIG. 2 is a perspective view of a modular building structure employing a plurality of cladding panels which are connected side to side using the joint connector arrangement provided by the present invention.

Referring now to FIG. 2, there is illustrated a building structure 30 which includes a structural steel framing indicated generally at 32, and a plurality of cladding panels 34 which are assembled together on the outside of the frame work 32 to enclose the structure. Such cladding arrangement can be used for erecting factory buildings, warehouses, and high-rise structures, for example. The building structure 30 has a roof 36 which is supported on a roof bearing top plate 37 which extends around the upper periphery of the building structure 30. In the building structure 30, adjacent panels 34 are connected together side to side by the joint connector arrangement provided by the present invention which additionally anchors the panels to the building foundation and ties the roof to the building foundation as will be shown.

Although the structural panels are shown in FIG. 1 used in modular buildings structures in which the panels 24 form the outer walls and the roof, and are shown in FIG. 2 used as cladding panels 34, such structural panels can be used in many different types of structures or enclosures, and interconnected by the joint connector arrangement provided by the present invention. For example, such structural panel can be used as walls and roofs in modular houses as disclosed in U.S. Pat. No. 3,848,376 or in small sheds, garages and the like, or as the sides and top of refrigerator trailers, tractor trailers, truck enclosures or other vehicular enclosures.

Figure 3:
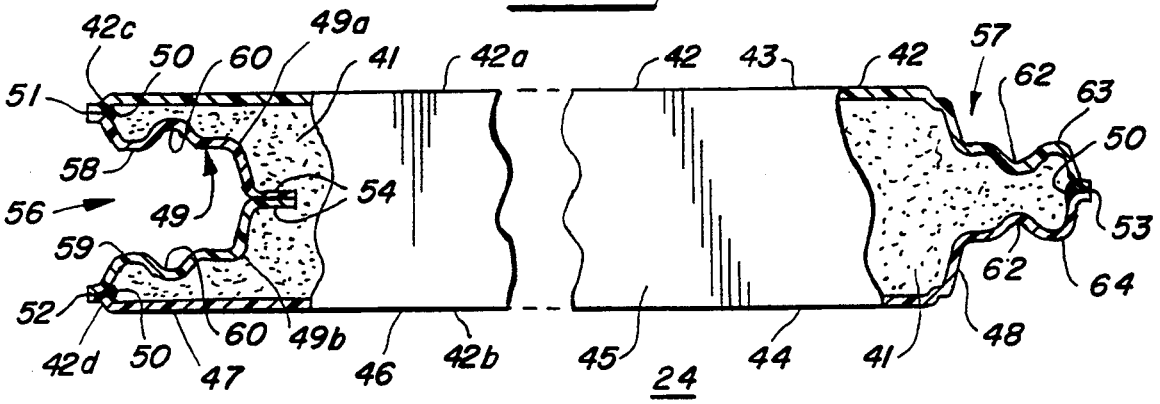
FIG. 3 is a plan view of a prefabricated panel provided by the present invention, partially broken away to illustrate details of the connector ends of the panel.
Figure 4:
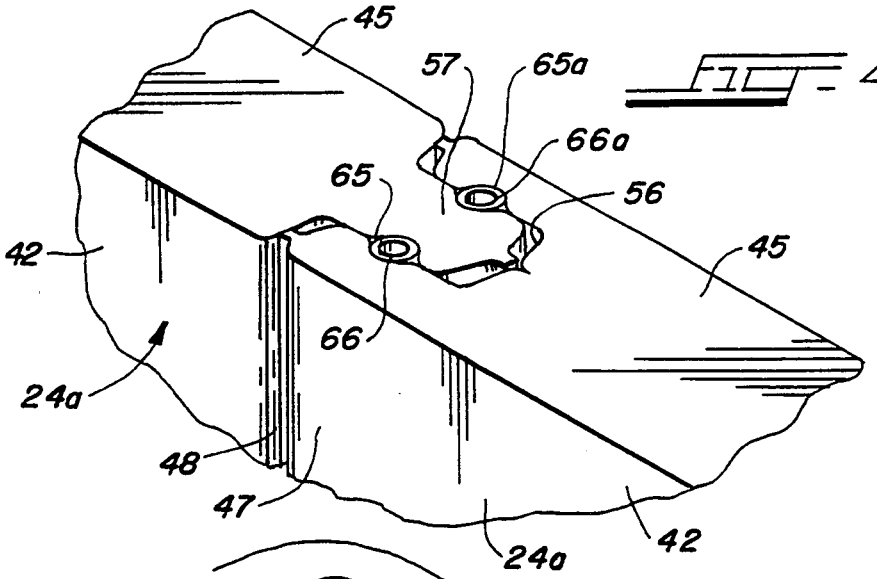
FIG. 4 is an enlarged isometric view of a portion of a pair of adjacent prefabricated panels shown interconnected by the joint connector arrangement provided by the present invention.
Figure 5:
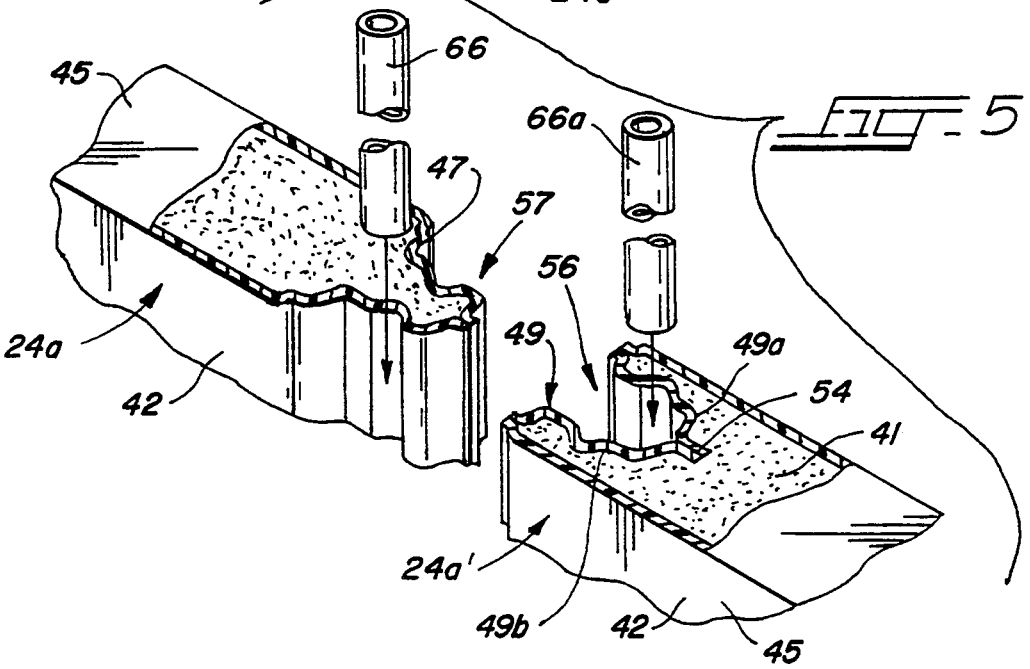
FIG. 5 is an exploded view similar to FIG, 4, illustrating the elements of the joint connector arrangement provided by the present invention.

Referring to FIGS. 3, 4 and 5, each panel 24 includes a core or main body portion 41 of cured polyurethane foam or other suitable cured foamable resin composition. The foam core is encapsulated by a fiberglass skin 42 which is integrally secured to the core 41 by projecting fiberglass fibers in the manner disclosed in U.S. Pat. Nos. 3,846,524 and 4,091,142.

As will be shown, the skin 42 is formed in two sections 42*a* and 42*b*, one section being the mirror image of the other section. The skin 42 covers the core 41 on five sides, including the front side 43, the rear side 44, the top or upper side 45 and the bottom or lower side (not shown, which is a mirror image of top 45) and the right side 48 (as shown in FIG. 4) of the panel 24. The left side 47 of the panel 24 is closed by a generally U-shaped insert 49 of a rigid material. In the exemplary embodiment, the insert 49 is a two piece assembly including identical members 49*a* and 49*b* which are joined together along edges 54 by adhesive or in any other suitable manner. However, the insert can be a one-piece member. The insert 49 is molded from plastic or other suitable material. Sections 42*a* and 42*b* of the skin have inwardly directed edges 42*c* and 42*d*, respectively, secured to the insert 49 by adhesive 50 along respective vertical seams 51 and 52 at side 47 of the panel. Section 42*a* is secured to section 42*b* by adhesive 50 along a vertical seam 53 at side 48 of the panel. By way of example, adhesive 50 may be an adhesive sold under the name P.D. George adhesive and commercially available from P.D. George Co. of St. Louis, Mo. 63166.

The total encapsulation of the urethane foam core 41 on all six sides by the fiberglass skin 42 and the insert member 49 provides a structural panel having high resistance to gas permeation. This total encapsulation of the core essentially eliminates "degassing" of freon from the structural panel that could otherwise result in a decrease in the R-value. Moreover, this total encapsulation substantially prevents moisture from entering the panel. The presence of moisture in the panel cell could cause delamination of the skin from the core. The core 41 is encapsulated on five sides with the fiberglass skin 42, which is a non-porous material, as compared to wood, etc. and thereby impervious to air and moisture. Likewise, the insert 49 which encloses the sixth side 47 of the panel, is made of a plastic material which resists the intrusion of air and/or moisture into the core 41, preventing outgassing of freon gas out of the panels. Totally encapsulating the core 41 on all six sides results in a stronger panel which is capable of sustaining higher wind and snow loads than a panel having the foam core exposed on one or more sides of the panel. Moreover, because the foam core 41 is totally enclosed, this substantially eliminates the possibility that insects or rodents could nest in the panel. In addition, during erection of a structure employing the panels provided in accordance with the present invention, there is no need to prepare or treat the construction site or to take precautionary steps or preventive maintenance to avoid nesting of insects and rodents as there could be with foam panels made with other facing materials.

Each panel 24 has a groove 56 in one side 47 defined by insert 49 and a tongue 57 at its other side 48 to permit adjacent panels to be joined together side to side in a dovetail fashion. Side walls 58 and 59 of groove 56 have a pair of semicircular indentations 60 which are aligned with a complementary pair of semicircular indentations 62 in the side walls 63 and 64 of the tongue 57 of a mating panel. The aligned indentations define two generally cylindrical, vertically extending channels 65 and 65*a* as illustrated for adjacent panels 24*a* and 24*a'* shown in FIG. 4. The panels are interconnected by elongated cylindrical rods or tubes 66 and 66*a* which extend through the channels 65 and 65*a*, respectively, as shown in FIG. 4 to lock the two panels 24*a* and 24*a'* together. The diameter of the tubes 66 and 66*a* is approximately the same as the diameter of channels 65 and 65*a*. Thus, tubes 66 and 66*a* engage the surfaces of the mating indentations, preventing relative side to side movement of panels 24, 24*a* in a direction normal to the axis of the channels. The tubes 66 and 66*a* also provide positive alignment of adjacent panels 24*a* and 24*a'*, preventing shifting of the panels during erecting of the structure.

In erecting a structure including panels 24, the panels are assembled together in a side by side relation with the tongue 57 of one panel received in the groove 56 of the adjacent panel, as illustrated in FIG. 4. The panels are located in side by side relation by positioning one panel adjacent to and beside a second panel and moving the panel to locate its tongue in the groove of the adjacent panel. In some instances, one panel may be positioned beside and above the other panel and lowered into place. A suitable adhesive 50, such as P.D. George adhesive, is applied to mating surfaces of panels to be interconnected prior to positioning of the two panels in side by side relationship.

In the illustrated embodiment, the channels 65 and 65*a* and the rods 66 and 66*a* extend the length of the panels 24 and 24*a* between the top and bottom edges thereof. However, the channels 65 and 65*a*, and rods 66 and 66*a* may extend only partially upwards from the bottom edge of the panel, partially downwards from the top of the panel or two sets of rods may be provided extending downwardly from the top and upwardly from the bottom of the panel. Also, although the indentations are illustrated as being semicylindrical, the indentations can be of other shapes, such as rectangular, oval, etc. The rods 66 and 66a are illustrated as hollow tubular members, but can be solid rods. The rods 66 and 66a can be made of rigid plastic, metal, wood or even conventional wire conduit or masonry products, such as concrete cement, mortar mix, etc. When the rods are wire conduit, electrical wiring for the building structure can be carried by the rods between floor and ceiling, floor to floor, etc. Further, and in accordance with another aspect of the invention, the upper and/or lower ends of the rods 66 and 66a can include suitable connection means which facilitates connection of the rods, and thus the wall panels that the rods interconnect, to the foundation and/or ceiling or roof of the structure as is more fully described herein with reference to FIGS. 9–16.

The panels 24 are produced using techniques similar to those disclosed in U.S. Pat. No. 3,846,524, for example. Briefly, the fiberglass skin 42 is molded to shape in two sections 42a, 42b, forming the outline of the main body portion 41, the tongue 57 and the groove 56 for the ends of the panel. The two sections are assembled together forming essentially a five sided box open at one side. The cavity formed by the assembled together mold sections is filled with a foamable resin. The open end of the assembled mold sections is closed by the insert 49.

Figure 6:
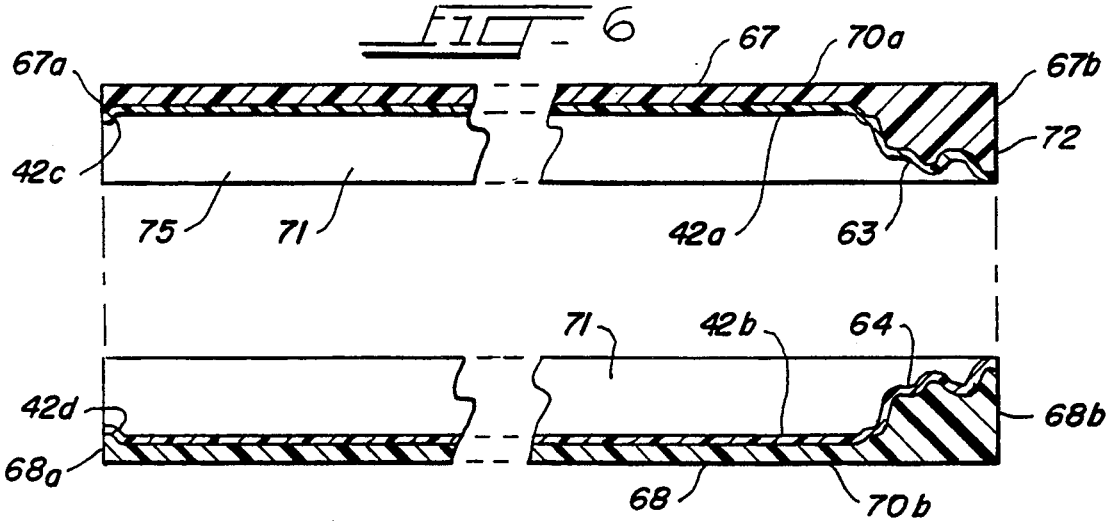
FIG. 6 is an end sectional view of the two-part mold used in producing the side skins of a structural panel, the two parts of the mold being separated, illustrating the cross-section of the two side skins.
Figure 7:
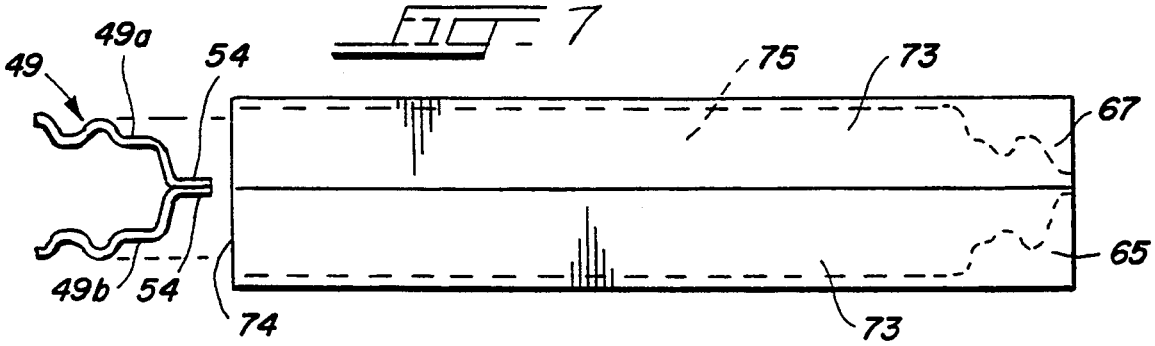
FIG. 7 is an end view of the mold with the two parts of the mold assembled together, closing the mold, the insert being shown positioned for assembly with the mold.
Figure 8:
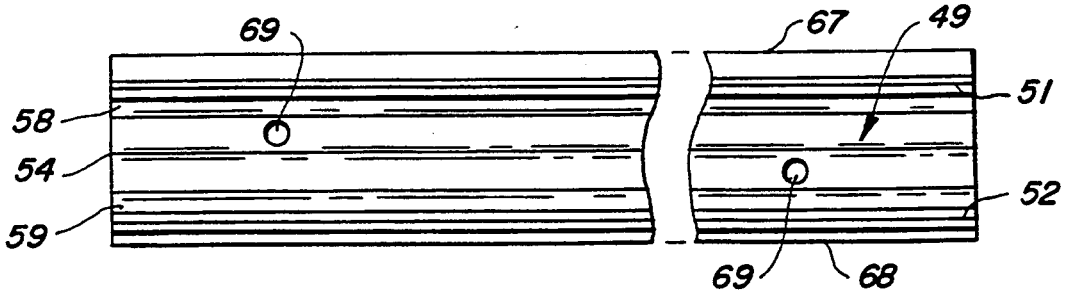
FIG. 8 is an end view of the mold illustrating the insert in place and connected to side skins, prior to introduction of the foamable resin.

More specifically, with reference to FIGS. 6–8, the two skin sections 42a and 42b are produced in a two-piece mold having mold sections 67 and 68, in a manner similar to that disclosed in U.S. Pat. No. 3,846,524. To form the two side skin sheets 42a and 42b, a coat of polyester known as gel coat is first applied to the inner surface of each of the two mold sections 67 and 68. The mold sections 67 and 68 have a plan area substantially equal to the area of the structural panel being made and a configuration corresponding to the configuration desired for the peripheral edges of the panel. The inner surfaces of the top 70a and bottom 70b of the mold produce the front side 43 and rear side 44 of the skin 42. Ends 67a and 68a of the mold sections 67 and 68 define the inwardly directed edges 42c and 42d of the skin sections. Ends 67b and 68b define the stepped side walls 63 and 64 of the side skins. Depending sides 71–73 of the mold produce the top side 45, the right side 48 and the bottom respectively of the skin 42. After the gel coating has been applied, a layer of polyester resin is deposited directed onto the gel coat layer. Next, a layer of chopped glass strands or fiberglass roving is applied to the first layer of resin, before it cures. The fibers are forced into the first layer of resin by suitable means to insure that the fibers become completely impregnated within the polyester resin and to provide the reinforcing characteristics of the laminate.

Then, a second layer of polyester resin is applied onto the resin-fiber laminate, before curing of the first layer so as to insure cross-linking between the first and second layers of resin. Thereafter, a second layer of chopped fiberglass roving is applied to the second layer of resin, prior to curing of the second resin layer. The second layer of glass fibers is not, however, rolled or otherwise forced into the second layer of resin. Rather, fiber end portions of the second layer of fibers are allowed to partially project outwardly from the second layer of resin but with each of the fibers at least partially integrally embedded into the second layer of resin. The resin and fiberglass roving layers are then allowed to cure.

After making two skin sheets 42a and 42b in accordance with the method above described, the two mold sections 67 and 68 with skin sheets therein are oriented one above the other as shown in FIG. 6, and the upper mold section 67 is moved to rest on top of the lower mold section 68 forming essentially a five sided box which is open at one side 74 as illustrated in FIG. 7. The two skin sections 42a and 42b are joined together along the peripheral edge by the adhesive 50 defining the seam 53 (FIG. 3).

Then, the insert 49 is inserted into the open side 74 of the mold. The insert 49 is permanently secured to the edges 42c and 42d of the skin 42 by a suitable adhesive 50 (FIG. 3) forming seams 51 and 52 as illustrated in FIG. 8. The insert 49 has a plurality of openings 69 therethrough which communicate with the cavity 75 formed by the two skin sections 42a and 42b and the insert 49. Although only two openings 69 are shown, the number of openings 69 provided depends on the size of the panel and the manner in which the depositing probes are manipulated in discharging foam into the cavity. For example, one opening may be provided for every two feet of length of the open end of the mold. Thus, a ten foot mold would have five openings.

Then, foamable resin composition is introduced into the cavity 75 by one or more depositing probes (not shown) in a manner similar to that described and illustrated in U.S. Pat. No. 3,846,524. The discharge probes are inserted through the openings 69 in the insert 49 and caused to move in a scanning direction across the mold cavity 75 generally transverse to the longitudinal axis of the discharge probe as described in the referenced patent. That is, the two probes are inserted into the mold near the center of the mold with their outlet ends aimed toward the corners. The foam is supplied to the discharge probes which are caused to sweep to the center of the mold and then swept back toward the corners. The probes are withdrawn slightly with each scan operation as the form is being introduced into the cavity. After the cavity 75 is filled with the foamable resin and the resin has cured, the openings 69 are closed by a suitable closing material such as a plastic cover attached to the insert 49, a layer of polyurethane varnish or other suitable gas and moisture impervious sealing material. It is pointed out that in assembly of the panel with other panels, the tongue portions 57 of a mating panel overlies the location of the apertures 69 so that the surface of the tongue 57 substantially closes the openings 69. Also, a layer of adhesive is applied to the surface of the insert 49, including the locations of the apertures 69. Thus, the core of the panels is completely enclosed, even the openings 69 through which the foamable resin composition is introduced into the cavity 75 defined by the skin 42 and insert 49.

Figure 9:
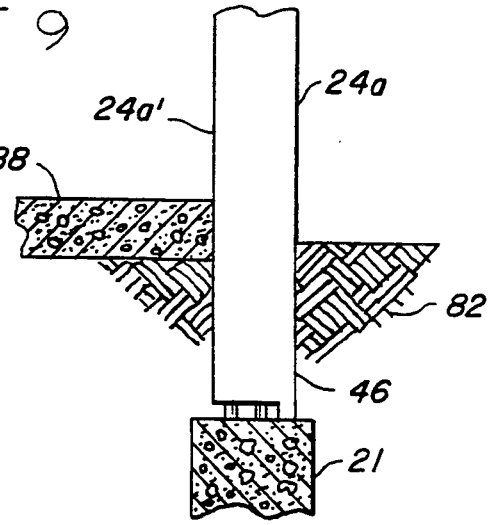
FIG. 9 is a partial vertical sectional view illustrating the manner in which a prefabricated panel is anchored to a foundation of the building structure of FIG. 1.
Figure 9A:
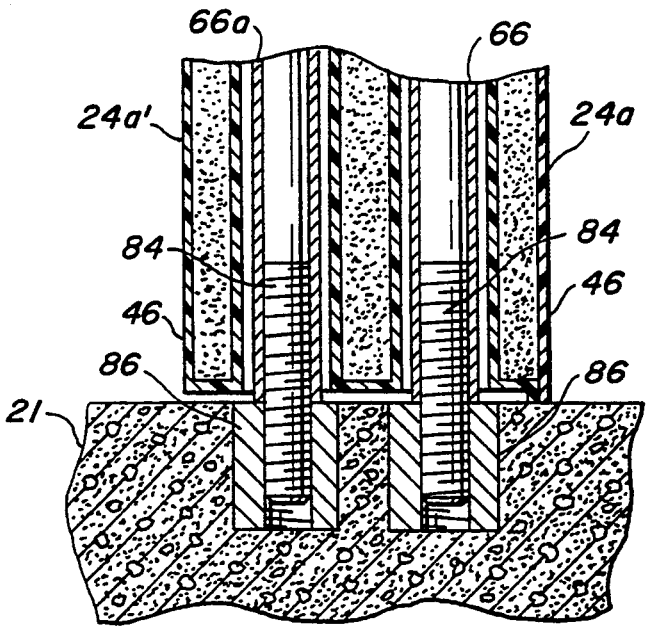
FIG. 9A is an enlarged view illustrating details of the anchoring of a panel to the foundation.

Referring now to FIGS. 1, 9, and 9A, there is shown a foundation construction embodying the principles of this invention for anchoring the structural wall panels 24a, and 24a' which form the exterior walls of the lower floor of the modular building structure, to the footing 21 of the structure 10. At the construction site, the concrete footing 21 for supporting the lower edge of the structural wall panels 24a and 24a' is poured to define an outline corresponding to the exterior dimensions of the floor plan of modular building structure 10. The footing 21 is formed below ground level and with the lower edges 46 of the wall structural panels 24a and 24a' resting in place on the footing, dirt fill 82 is shoveled on opposite sides of the wall panel up to the grade level.

Each of the tubes 66 and 66a has a threaded rod 84 press fitted into the tube at its lower end and extending slightly beyond the lower end of the tube. Alternatively, the lower end of the tube itself may be threaded. The footing 21 includes a pair of lead anchors 86 at each location of each joint for receiving the threaded rods 84. The rods 84 are tightened into the anchors 86 by rotating the tubes 66 and 66a from their upper ends. If there is access from underneath to the lower end of the tube, the rods may be tightened onto the anchors at the bottom of the tubes.

The tubes 66 and 66a both interconnect adjacent panels and anchor the interconnected panels to the footing. A single tube may interconnect a first pair of adjacent panels on the lower level and second pair of adjacent panels on the upper level, i.e., the tube extending from the roof-line to the foundation. Also, two coaxially extending tubes may be connected together, one of the tubes connecting a pair of adjacent panels on the lower level and the other tube interconnecting a pair of adjacent panels on the upper level. Once the exterior wall panels 24a and 24a' are set in place on the footing 80, a concrete floor 88 is poured across the inner floor area of the structure.

Figure 10:
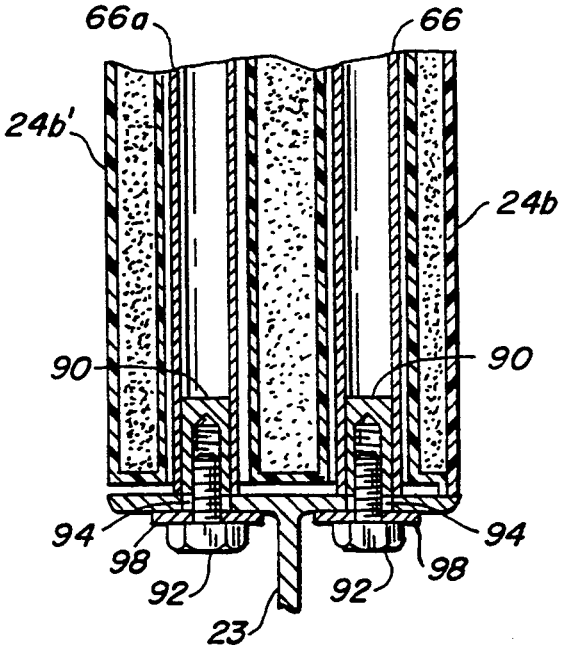
FIG. 10 is a partial vertical sectional view illustrating the manner in which a prefabricated panel is connected to a structural beam of the building structure of FIG. 1.

Referring to FIGS. 1 and 10, the wall panels 24b and 24b' which form the exterior walls of the upper floor of the structure 10, are shown anchored to structural beams 23 which support the floor 22 of the modular structure 10. Each of the tubes 66 and 66a includes a threaded bushing 90 which is press fitted into the lower end of the tube. The tubes 66 and 66a are secured to the structural beam 23 by machine screws 92 which pass through apertures 94 in the beam 23. A washer 98 is provided between the head of each screw 92 and the underside of the beam 23.

Figure 11:
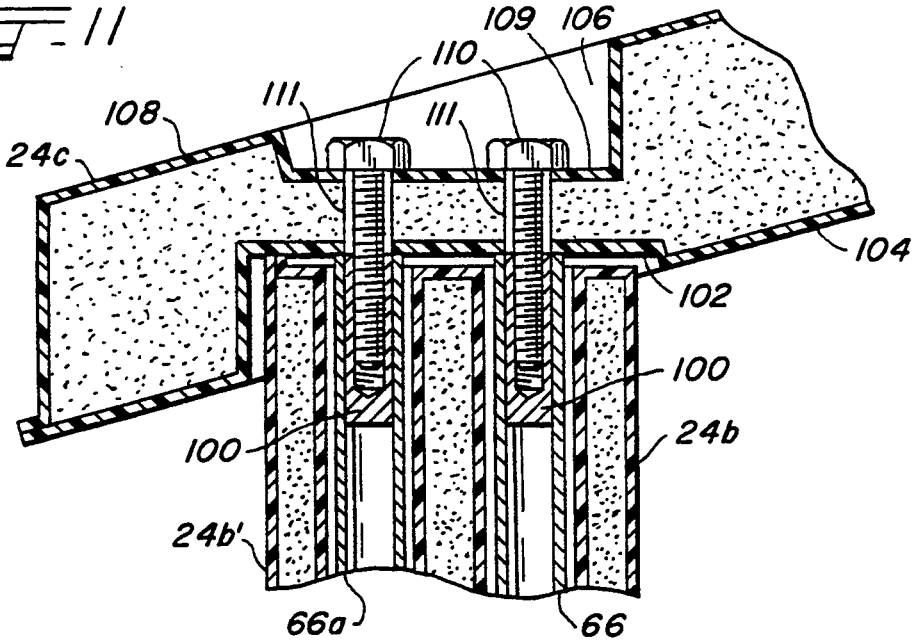
FIG. 11 is a partial vertical sectional view illustrating the manner in which a prefabricated panel is connected to the roof of the building structure of FIG. 1.

Referring to FIGS. 1 and 11, the wall panels 24b and 24b' are connected to the roof panels 24c provided by the present invention, which form the roof 22 of the modular structure 10. Each of the tubes 66 and 66a includes a threaded bushing 100 which is press fitted into the upper end of the tube. Each of the roof panels 24c has an indentation 102 formed in its undersurface 104 to receive the upper end of the two underlying wall panels 24b and 24b'. A corresponding indentation 106 is formed in the upper surface 108 of the roof panel 24c to define a horizontal mounting surface 109 to facilitate connection of the roof panel to the wall panel by machine screws 110 which pass through apertures 111 in the mounting surface 109 and are received in the threaded bushings 100 to secure the roof panel 24c to the upper wall panel 24b and 24b'. Although the roof panels 24c preferably are foam core panels provided in accordance with the present invention, the roof panels 24c may be any type of panel suitable for application as a roofing member in a building structure. Moreover, the roof could comprise only one panel for a flat roof, or only two panels for a tipped roof.

Referring to FIGS. 1 and 9–11, with the rods 66 and 66a, which interconnect panels 24a, anchored to the foundation 21 at their lower ends, and the rods 66 and 66a, which interconnect panels 24b, connected to the floor structure 23 and to the roof 20, the roof is effectively tied to the foundation of the structure. For single story structures, the roof is tied directly to the foundation through the rods which interconnect the structural wall panels of such structure.

Figure 12:
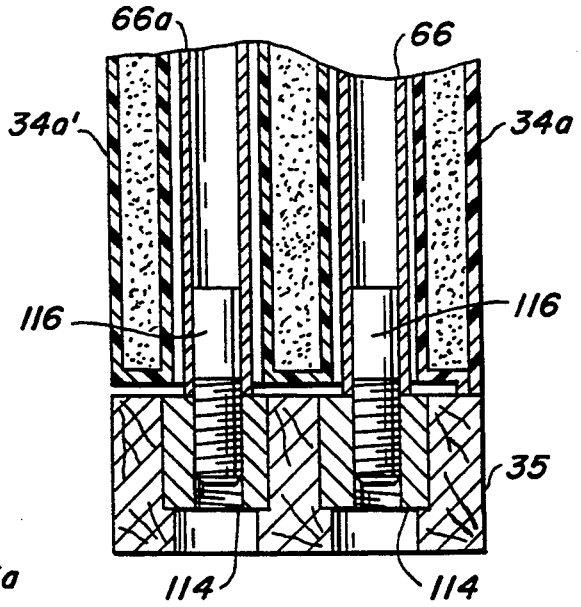
FIG. 12 is a partial vertical sectional view illustrating the manner in which a prefabricated panel is connected to a sill plate of the building structure of FIG. 2.

Referring to FIGS. 2 and 12, the lower ends of a pair of cladding panels 34a and 34a' which enclose the frame work 32 of the modular structure 30 are anchored to the sill plate 35 of the modular structure 30. The sill plate 35 has a pair of threaded inserts 114 which are imbedded into the sill plate. Each of the tubes 66 and 66a has a threaded rod 116 which is press fitted into the end of the tube. The threaded rod 116 is screwed into the threaded insert or bushing 114 by rotating the tube at its upper end, thereby securing the panels 34 and 34a to the sill plate 35.

Figure 13:
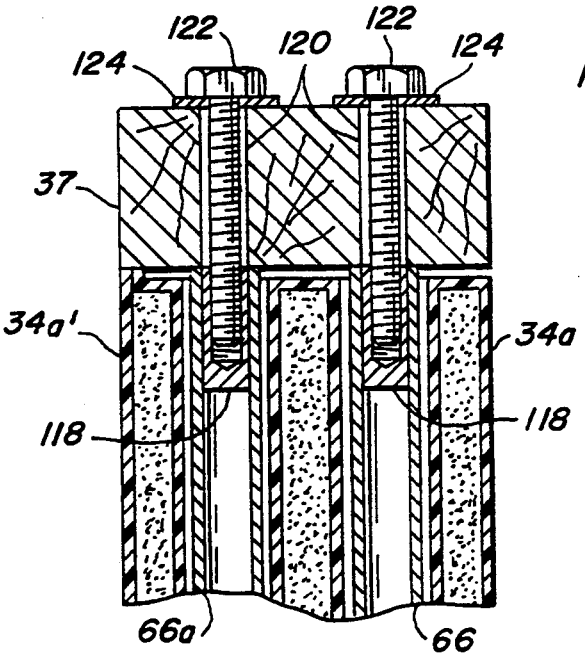
FIG. 13 is a partial vertical sectional view illustrating the manner in which a prefabricated panel is connected to a roof bearing top plate of the building structure of FIG. 2.

Referring to FIGS. 2 and 13, the upper ends of the cladding panels 34a and 34a' are shown connected to the roof bearing top plate 37 of the modular structure 30. Each of the tubes 66 and 66a has a threaded bushing 118 press fitted into its upper end and aligned with apertures 120 through the top plate 37. The panels 34 are secured to the top plate 37 by machine screws 122 which pass through the apertures 120 and are screwed into the bushings 118. A washer 124 is located between the head of the screw 122 and the top side of the top plate 37.

Referring to FIGS. 2, 12 and 13, with the lower ends of the rods 66 and 66a, which interconnect panels 34a and 34a', connected to the foundation through the sill plate 35, and with the upper ends of the rods 66 and 66a connected to the roof bearing top plate 37, the roof of the structure 30 is tied to the foundation of the structure 30 through the rods and the panels which they interconnect.

Although the panels 34 are illustrated oriented vertically, the panels may be disposed horizontally with the tubes extending horizontally, interconnecting two or more pairs of end to end panels. In such structure, the ends of the interconnecting tubes are secured to vertical frame members at the corners of the structure or to vertical frame members intermediate the corners of the structure.

Figure 14:
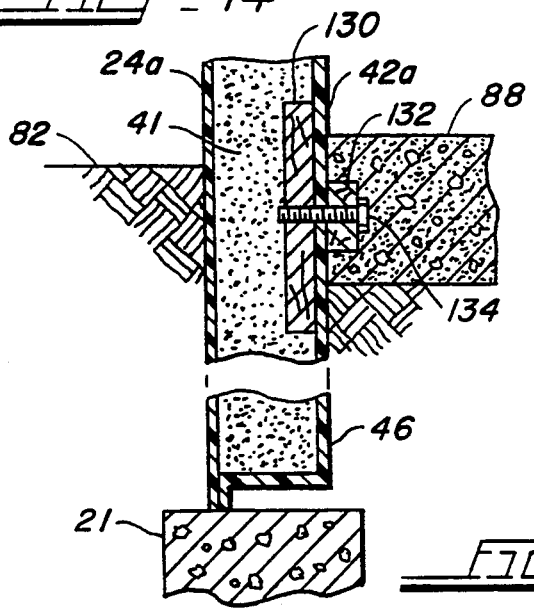
FIG. 14 is a simplified representation of a prefabricated panel and a concrete footing of a structure illustrating the manner in which the prefabricated panel is attached to a concrete footing of a building structure.

Referring to FIG. 14, there is illustrated an arrangement provided in accordance with the present invention for connecting a panel 24a at its lower end 46 to a concrete floor 88 of a structure. The lower end 46 of the panel 24a rests on the concrete footing 21 of the structure. The panel 24a includes a mounting member 130 which is located interiorly of the panel 24a. The mounting member 130 may comprise a strip of $\frac{3}{4}$ inch plywood which is glued or otherwise attached to the inside of the skin 42a of the panel prior to the introduction of the foamable resin core material during manufacture of the panel. Preferably, the mounting member 130 extends the width of the panel near its lower end 46. The mounting member 130 is encapsulated within the foamable resin when it is introduced into the panel during manufacture of the panel. A support strip 132 which may be a treated $2\times4$, is fastened securely to the panel by screws 134 which penetrate the fiberglass skin 42a into the mounting member 130. When the concrete flooring 88 is poured, the concrete is poured around the supporting member 132 which acts as a support shoulder, so that when the concrete 88 sets, the panel is connected to the concrete floor by the mounting members 130 and 132 and acts as an anchoring system or method.

Figure 15:
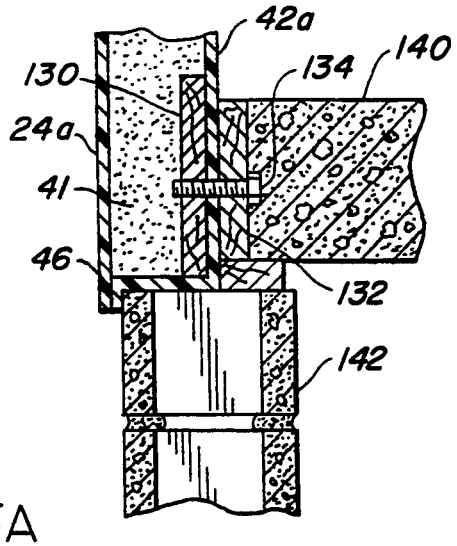
FIG. 15 is a simplified representation of a prefabricated panel and a portion of a flooring system of a structure, illustrating the manner in which the prefabricated panel is connected to a flooring system of a building structure.

Referring to FIG. 15, panel 24a may be secured to a flooring system 140 of a structure. The lower end 46 of the panel 24a rests on the uppermost block 142 of a concrete block foundation. A mounting member 130 is provided interiorly of the panel 24a, encapsulated in the foam core 41, as described above with respect to FIG. 14. A supporting member 132, such as a $2\times8$, is secured to the mounting member 130 by screws 134 which penetrate the skin 42a. The flooring system 140 is connected to the support member 132, thereby securing the panel 24a to the flooring system 140.

Figure 15A:
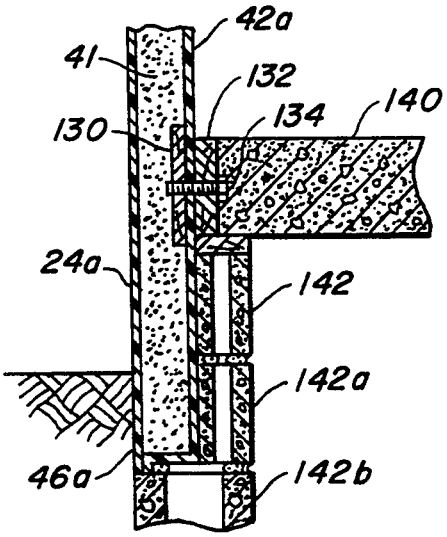
FIG. 15A is a view similar to FIG. 15, but showing the panel lower ends supported below grade.

Referring to FIG. 15A, in some instances, it is advantageous to support the lower end 46 of the panel 24a below grade. In the embodiment shown in FIG. 15A, the two upper courses of the concrete block foundation are formed by laying four inch wide blocks 142a on eight inch wide blocks 142b as the two upper courses. The lower end 46 of the panel rests on the upper surface of block 142b which forms the third course from the top of the concrete block foundation. Thus, the lower inner surface 46a of the panel 24a engages the concrete blocks 142a and the lower outer surface is covered by soil. This provides more panel rigidity and better insulation for the structure.

Figure 16:
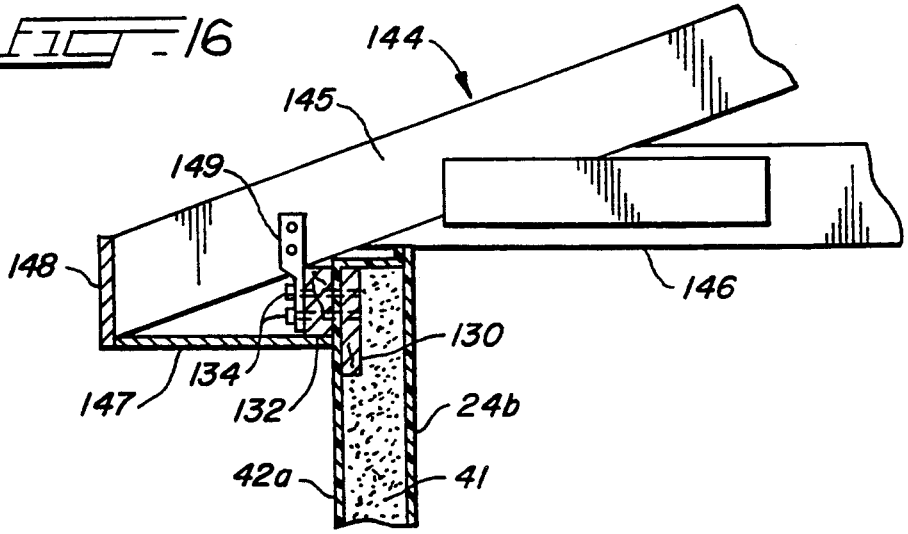
FIG. 16 is a simplified representation of a prefabricated panel and a portion of a roof of a structure, illustrating the manner in which a prefabricated panel is connected to a roof of a building structure.

Referring now to FIG. 16, in a similar manner, a mounting member 130 provided interiorly of panel 24b enables the panel to be connected at its upper end to a roofing system 144 including rafter 145, joist 146, soffit 147 and header 148. A supporting member 132 is secured to the mounting member 130 by screws 134 which pass through the supporting member 132 and the fiberglass skin 42a of the panel 24b into the mounting member 130. The supporting member 132 is connected to a joist hanger 149 which is supported from a rafter 145, thereby connecting the panel to the roofing system.

Thus, FIGS. 14–16 illustrate arrangements provided in accordance with the present invention for connecting a panel to a concrete floor, a flooring system and a roofing system, wherein a mounting member 130 is encapsulated within the panel 24a and serves to connect the panel to a supporting member 132 which in turn is connected to an element of the building structure, such as the concrete floor 88 as shown in FIG. 14, a beam of the flooring system 140 as illustrated in FIG. 15 or an element of the roofing system 144 as illustrated in FIG. 16. The connection arrangements illustrated in FIGS. 14–16 may be used in conjunction with the connection arrangements illustrated in FIGS. 9–13 to connect both the top and bottom ends of the structural panel to elements of a building structure, and for example, in some applications, such as connecting a panel lower end to a footing, or connecting the upper end of a panel to a roofing system, both connecting arrangements shown in FIGS. 9 and 14, or FIGS. 11 and 16, may be used.

I claim:

1. In a structural panel including a core of cured foam resin composition having a configuration corresponding substantially to the desired shape of the structural shape of the panel and including front and rear surfaces and first and second side skin sheets integrally secured to front and rear surfaces of said core, at least one of said side skins being made of a cured fiber reinforced resin including a first layer of resin which has reinforcing material to provide increased strength for the sheet, and a second layer of resin on said first layer having a plurality of fibers with portions thereof embedded in said second layer and other portions of the fibers projecting from a surface thereof into and integrally adhering with said foam core, the improvement comprising: first, second and third side skin portions interconnecting said first and second side skin sheets and secured to first, second and third side surfaces of said foam core, defining an enclosure for said foam core having an open end, and an insert member mounted in said open end of said enclosure and secured to said first and second side skin sheets and to at least said first and second side skin portions, whereby said foam core is encapsulated within said enclosure, wherein said insert member is integrally secured to said foam core along substantially the entire length of the open end thereof, and wherein said insert member defines a receptor and a second one of said panel edges defines a groove and wherein said insert member has a generally U-shaped cross-section.

2. The structural panel according to claim 1, wherein said insert member and said side skin sheets are impervious to gas and moisture.

3. A structural panel according to claim 1, including a connecting member embedded in the foam core internally of the panel for connecting the panel to a building structure.

4. The structural panel according to claim 1 wherein said panel has an upper edge, a lower edge, and first and second side edges, the first side edge of the panel having tongue portion extending between the upper and lower edges of the panel, and the second side edge of the panel having a groove extending between the upper and lower edges of the panel for receiving a tongue portion of a further panel when said panels are arranged with their side edges disposed adjacent to one another, the tongue portion having first and second surfaces opposing respective first and second surfaces of the groove, and an indentation in at least said first surface of the tongue portion between the upper and lower edges of the panel, the indentation in at least the first surface of the groove extending between the upper and lower edges of the panel.

* * * * *